US006957611B2

(12) United States Patent
O'Donnell et al.

(10) Patent No.: US 6,957,611 B2
(45) Date of Patent: Oct. 25, 2005

(54) CONSTANT CONTACT SIDE BEARING ASSEMBLY FOR A RAILCAR

(75) Inventors: William P. O'Donnell, Aurora, IL (US); Paul B. Aspengren, Elmhurst, IL (US)

(73) Assignee: Miner Enterprises, Inc., Geneva, IL (US)

( * ) Notice: Subject to any disclaimer, the term of this patent is extended or adjusted under 35 U.S.C. 154(b) by 0 days.

(21) Appl. No.: 10/785,097

(22) Filed: Feb. 24, 2004

(65) Prior Publication Data

US 2005/0183626 A1 Aug. 25, 2005

(51) Int. Cl.[7] ..... F16F 1/36
(52) U.S. Cl. ..... 105/199.3; 384/423
(58) Field of Search ..... 105/199.1, 199.3; 384/423; 267/3, 269, 292

(56) References Cited

U.S. PATENT DOCUMENTS 3,707,927 A * 1/1973 Geyer et al. ..... 105/199.3
3,735,711 A 5/1973 Hassenauer
3,910,655 A 10/1975 Willison et al.
3,915,520 A 10/1975 Hassenauer
3,957,318 A 5/1976 Wiebe
4,355,583 A 10/1982 Eggert, Jr.
4,567,833 A 2/1986 Hanson
4,793,720 A 12/1988 Merker
4,998,997 A 3/1991 Carlston
5,048,427 A 9/1991 Dumoulin
5,086,707 A 2/1992 Spencer et al.
5,386,783 A 2/1995 Rhen et al.
5,601,031 A 2/1997 Carlson
6,092,470 A 7/2000 O'Donnell

OTHER PUBLICATIONS

Miner Enterprises, Inc.; TecsPakConstant Contact Side Bearings; 1996; 2 pages; Geneva, Illinois, U.S.A.
One page, two-sided sales brochure entitled "Constant Contact Side Bearing Retrofit Kits" by Miner Enterprises, Inc., undated.

* cited by examiner

*Primary Examiner*—Mark T. Le
(74) *Attorney, Agent, or Firm*—John W. Harbst

(57) ABSTRACT

A constant contact side bearing assembly configured for insertion into a walled receptacle on an upper surface of a railcar bolster. The constant contact side bearing assembly includes a housing defining a cavity and a spring. A cap is positioned by and overlies an end of the spring. The cap is mounted for reciprocatory guided movements by and relative to the housing, with a generally flat railcar body engaging portion on the cap being positioned relative to the housing and the walled enclosure by the spring. The side bearing assembly further includes an apparatus for securing the housing of the side bearing assembly within the walled receptacle on the railcar bolster.

19 Claims, 2 Drawing Sheets

CONSTANT CONTACT SIDE BEARING ASSEMBLY FOR A RAILCAR

FIELD OF THE INVENTION

The present invention generally relates to railcars and, more particularly, to a constant contact side bearing assembly for a railcar.

BACKGROUND OF THE INVENTION

On a railcar, wheeled trucks are provided toward and support opposite ends of a railcar body for movement over tracks. Each truck includes a bolster extending essentially transversely of the car body longitudinal centerline for supporting the railcar body. In the preponderance of freight cars, a pivotal connection is established between the bolster and railcar body by center bearing plates and bowls transversely centered on the car body underframe and the truck bolster. Accordingly, the truck is permitted to pivot on the center bearing plate under the car body. As the railcar moves between locations, the car body tends to adversely roll from side to side. Attempts have been made to control the adverse roll of the railcar body through use of side bearings positioned on the truck bolster outwardly of the center bearing plate. A "gap style" side bearing has been known to be used on slower moving tank/hopper railcars. Conventional "gap style" side bearings include a metal, i.e. steel, block or pad accommodated within a pocket defined on the truck bolster. An upstanding housing or cage, integrally formed with or secured, as by welding or the like, to the truck bolster defines the pocket and inhibits sliding movement of the metal block relative to the bolster. The pockets provided on the bolster can, and often do, differ in size relative to each other. As is known, a gap or vertical space is usually present between the upper surface of the "gap style" side bearing and the underside of the railcar body. Under certain dynamic conditions, combined with lateral track irregularities, the railcar truck also tends to oscillate or "hunt" in a yaw-like manner beneath the car body. The coned wheels of each truck travel a sinuous path along a tangent or straight track as they seek a centered position under the steering influence of the wheel conicity. As a result of such cyclic yawing, "hunting" can occur as the yawing becomes unstable due to lateral resonance developed between the car body and the truck. As will be appreciated, excessive "hunting" can result in premature wear of the wheeled truck components including the wheels, bolsters, and related equipment. Hunting can also furthermore cause damage to the lading being transported in the car body. Track speeds of rail stock, including tank/hopper cars, continues to increase. Increased rail speeds translate into corresponding increases in the amount of yaw or hunting movements of the wheeled trucks. As will be appreciated, "gap style" side bearings cannot and do not limit hunting movements of the wheeled trucks. As such, the truck components including the wheels, bolsters, and related equipment tend to experience premature wear.

Constant contact side bearings for railcars are also known in the art and typically include a base and cap. The base has a cup-like configuration and is suitably fastened to the bolster. The cap is biased from the base and includes an upper surface for contacting and rubing against an underside of the car body. As will be appreciated, the cap is free to vertically move relative to the side bearing base. Such constant contact side bearings furthermore includes a spring.

The spring for such side bearings can comprise either spring loaded steel elements or elastomeric blocks or a combination of both operably positioned between the side bearing base and the cap. The purpose of such spring is to resiliently urge the upper surface of the cap under a preload force and into frictional contact with the car body underframe. Elastomeric blocks appear to advantageously offer a more controlled friction at the interface of the side bearing cap and the car body underframe, preclude seizing, and create a less rigid shear constraint whereby permitting the wheeled trucks to negotiate minor track irregularities without breaking friction at the interface between the side bearing cap and the car body underframe. One such elastomeric block is marketed and sold by the Assignee of the present invention under the tradename "TecsPak."

Known constant contact side bearings are simply not designed to fit or be accommodated within existing pockets on a truck bolster of a railcar. The base of a typical constant contact side bearing includes attachment flanges or lugs radially extending from opposed sides of the base for securing the bearing assembly to the railcar truck bolster. Accordingly, to use a constant contact side bearing on railcar having a bolster with a pocket requires either replacement of the entire truck bolster or complete removal of the upstanding housing or cage, defining the pocket, from the surface of the bolster to which the attachment flanges or lugs of the side bearing are secured. Either proposal requires extensive manual efforts and, thus, is expensive while keeping the railcar out of service for an extended time period.

Some railcar designs further exacerbate the problem of fitting a constant contact side bearing thereto. In many railcar designs, a constant contact side bearing operates within a five and one-sixteenth inch nominal working space between the truck bolster and the car body underside. Such dimension usually provides sufficient space for the spring to develop the required preload force for the side bearing. In other railcar designs (i.e., tank/hopper railcars), however, the vertical space between the bolster, to which the side bearing is secured, and the car body underside is severely restricted. In fact, some railcar designs provide only about a two and five-eights inch nominal working space between the truck bolster and the underside of the railcar. The reduced work space envelope provided on many railcar designs is to limited to accommodate a constant contact side bearing to control such hunting movements.

Additionally, heat buildup in proximity to an elastomeric spring of constant contact side bearings is a serious concern. While advantageously producing an opposite torque acting to inhibit the yaw motion of the truck, the resulting friction between the side bearing and underside of the car body develops an excessive amount of heat. The repetitive cyclic compression of the elastomeric block coupled with high ambient temperatures, in which some railcars operate, further exacerbate spring deformation. As will be appreciated, such heat buildup often causes the elastomeric block to soften/deform, thus, significantly reducing the ability of the side bearing to apply a proper preload force whereby decreasing vertical suspension characteristics of the side bearing resulting in increased hunting.

Thus, there is a continuing need and desire for a constant contact railcar side bearing design capable of use with railcar truck bolsters having a pocket for accommodating the side bearing and which is capable of effective operation in limited space constraints without serious deterioration on a long term basis.

SUMMARY OF THE INVENTION

In view of the above, and in accordance with one aspect, there is provided a constant contact side bearing assembly adapted to be arranged in combination with a railcar bolster defining an upper surface. The constant contact side bearing assembly includes a spring accommodated within a body member having wall structure extending about the spring. The wall structure of the body member is configured to fit within a walled receptacle on the upper surface of the railcar bolster. In one form, the wall structure of the body member and the walled receptacle include a pair of confronting surfaces disposed to opposed sides of an axis defined by said side bearing assembly and extending generally normal to the upper surface on the bolster. The side bearing assembly further includes an apparatus operably engagable with the walled receptacle on the bolster and the wall structure of the body member for locating the side bearing relative to the bolster. In a preferred form, such apparatus includes an insert positionable between each pair of confronting surfaces on the walled receptacle and body member so as to inhibit the side bearing from shifting relative to the bolster. The side bearing assembly further includes a friction member overlying one end of and for transmitting loads to the spring, with the friction member being guided relative to the body member.

In a preferred form, the friction member is secured in operable combination with and positions the spring relative to the body member. Preferably, the spring comprises a block of elastomeric material for absorbing energy imparted to the side bearing assembly and is configured to position the friction member relative to the bolster surface engaged by the spring.

In one embodiment, the body member of the side bearing assembly defines a recess extending through the body member. As such, that end of spring, opposite from the friction member, can extend through the body member to directly engage and abut the upper surface portion on the bolster. Accordingly, the overall length of the spring can be extended, thus, enhancing the load absorption capability of the side bearing assembly.

One surface of each pair of confronting surfaces is preferably inclined with respect to the other surface such that the surfaces diverge away from each other as the surfaces extend away from the bolster whereby defining a wedge shaped opening therebetween. In one form, the spacers or inserts for locating the side bearing assembly each has a wedge-shape to enhance its insertion into each opening defined between the confronting surfaces on the wall structure on the body member and the walled receptacle. In a most preferred embodiment, each wedge-shaped spacer or insert is secured to the walled receptacle to inhibit shifting movements of the side bearing assembly relative to the bolster surface.

According to another aspect, there is provided a side bearing assembly adapted for insertion into a pocket defined by a walled receptacle on an upper surface of a railcar bolster. The side bearing assembly includes a spring and a housing defining a cavity or recess. The body member is configured to fit within the walled receptacle on the upper surface of the bolster. The side bearing housing and walled receptacle define a pair of confronting surfaces disposed to opposite sides of an axis defined by the side bearing assembly. The side bearing assembly further includes an apparatus operably engagable with the walled receptacle and the the side bearing housing for operably securing the housing agaisnt movement relative to the railcar bolster. A cap or fiction member overlies one end of and transmits loads to the spring. The cap is mounted for reciprocatory guided movements by and relative to the housing, with a generally flat railcar body engaging portion on the cap being positioned relative to the housing and the walled enclosure by the spring.

The spring for the side bearing assembly preferably comprises a resilient spring block having a substantial portion thereof disposed within the cavity of the housing, and with the resilient spring block having a predetermined length and a predetermined cross-sectional shape. In one form, the generally flat railcar body engaging portion on the cap and the second end of the resilient block are configured with interlocking instrumentalities for securing the resilient block and the cap in operable combination relative to each other. The resilient spring block is preferably formed from an elastomer material.

In one form, the apparatus for operably securing the side bearing assembly housing relative to the railcar bolster includes spacers or inserts. Preferably, one spacer is insertable into each opening between each pair of confronting surfaces so as to locate and secure the side bearing assembly housing within the walled receptacle on the bolster.

In a most preferred form, one of the surfaces of each pair of confronting surfaces between the walled housing and walled receptacle is inclined with respect to the other surface such that the surfaces diverge away from each other and define a wedge shaped opening therebetween. According to this aspect, one of the spacers or inserts is insertable into each wedge shaped opening defined by the confronting surfaces on the walled housing and the walled enclosure to inhibit shifting movements of the walled housing and locating the side bearing assembly relative to said walled enclosure. Preferably, each spacer is configured as a wedge shim.

According to another aspect, there is provided a side bearing, assembly configured for accommodation in a rectangularly shaped, open top receptacle on an upper surface of a railcar bolster. The receptacle has a pair of spaced side walls and a pair of spaced end walls. The side bearing assembly includes a spring, and a housing defining a cavity wherein the spring is accommodated. In a preferred form, the housing has a generally rectangular shape including two sides and two ends, with each side and each end being disposed to opposite sides of an axis defined by the side bearing assembly. The generally rectangular shape of the housing loosely fits within the open top receptacle on the railcar bolster. A cap is positioned by and overlies an end of the spring. The cap is guided for telescopic movements relative to the bearing housing and includes a generally flat portion defining an upper extreme of the side bearing assembly following insertion of the side bearing assembly into operable combination with said railcar bolster. An apparatus is furthermore provided for positively securing the side bearing assembly housing relative to the railcar bolster.

In one form, the railcar side bearing assembly has a measurable distance ranging generally between 2.5 inches and 4.5 inches between an upper extreme of the side bearing assembly and the bolster surface after the bearing assembly after is accommodated in the receptacle on the bolster. Preferably, the spring is configured such that an upper portion of the bearing assembly is positioned above an upper extreme of the walls of the receptacle on the bolster as long as the side bearing assembly spring is in an uncompressed state and when initial loadings are directed against the side bearing assembly during operation of the railcar on which the side bearing assembly is arranged in operable combination.

Preferably, the spring for the side bearing assembly includes a resilient spring block having a predetermined length and a predetermined cross-sectional shape. In one form, the generally flat portion on the cap and the resilient block have interlocking instrumentalities for securing the resilient block and cap in operable combination relative to each other. In a most preferred form, the resilient spring block is formed from an elastomer material.

Because of concerns related to the adverse effects of heat on elastomers, the side bearing assembly housing is preferably configured to promote the dissipation of heat away from the elastomer spring block. In a preferred form, the cap is also configured to promote the dissipation of heat away from the elastomer spring block.

In one form, the ends of the side bearing housing and the end walls of the receptacle on the bolster define a pair of confronting surfaces disposed to opposite sides of the side bearing assembly axis. Each pair of confronting surfaces has at a surface portion inclined with respect to the other surface such that the surfaces diverge away from each other as they extend away from the upper bolster surface whereby defining a wedge-shaped opening therebetween. In one form, the apparatus for positively securing the side bearing assembly to the upper surface of said bolster includes spacers or inserts insertable into each wedge-shaped opening defined by the confronting surfaces on the housing and the receptacle to inhibit endwise shifting movements of side bearing assembly housing relative to the railcar bolster. Preferably, each spacer is configured as a wedge shim.

According to still another aspect, there is provided a constant contact side bearing assembly configured for insertion into a walled receptacle provided on a railcar bolster. The side bearing assembly includes a housing configured to fit within the walled receptacle on the bolster and defining a recess extending through the housing and is open at opposite ends. The housing and walled receptacle define a pair of confronting surfaces arranged on opposed sides of an axis defined by the side bearing assembly. A spring is configured for insertion within said housing. Inserts are provided for securing the housing of the side bearing assembly within the walled receptacle. At least one insert is positionable between the confronting surfaces on the walled receptacle and the housing on each side of the side bearing assembly. A cap overlies one end of the spring. According to this aspect, the cap is mounted for reciprocatory guided movements by and relative to the housing. A generally flat railcar body engaging portion on the cap is positioned relative to the housing and the walled receptacle by the spring.

In the illustrated form, the body member of the constant contact side bearing assembly is configured to allow the elastomeric spring to extend therethrough such that the end of the spring, opposed from the friction member, abuts with and directly engages with the upper surface of the bolster. In a preferred form, the friction member of the side bearing assembly is arranged in operable combination with and positions the spring relative to said body member.

According to still another aspect, there is provided a side bearing assembly arranged in combination with a railcar bolster connected to a wheeled truck. The side bearing assembly includes a walled receptacle adapted for securement to an upper surface on the bolster and a housing assembly configured to loosely fit within the receptacle on the bolster. The housing assembly includes a friction member with a railcar engaging portion spring biased for engagement with an underside of a railcar body portion for limiting hunting movements of the wheeled truck. The housing assembly further includes a hollow base for accommodating a spring used to bias the railcar engaging portion of the friction member into engagement with the underside of the railcar body and for guiding vertical movements of the friction member relative thereto. The side bearing assembly further includes an apparatus disposed between an inner surface on the walled receptacle and an outer surface on the base of the housing assembly for securing the base against movements and locating the side bearing assembly relative to the railcar bolster.

In one form, one end of the spring extends through the hollow base of the housing assembly to abuttingly engage with that portion of the upper surface of said bolster surrounded by the parameters of the walled receptacle. Preferably, the apparatus for securing the base of the housing assembly against movements includes at least one insert fixed between the inner surface on the walled receptacle and an outer surface on the housing assembly.

In view of the above, one feature of the present invention relates to the provision of a constant contact side bearing assembly designed and configured to be accommodated within a an existing pocket defined by an open top receptacle on a railcar bolster.

Another feature of the present invention relates to the provision of a constant contact side bearing assembly configured to be accommodated within a limited vertical space of less than 4.5 inches for stabilizing a railcar body.

Another feature of the present invention relates to the provision of a railcar side bearing assembly with a cushioning spring comprised of an elastomeric material having the maximum volume in the restrictive space provided by on an existing receptacle on a railcar truck bolster.

Yet another feature of the present invention relates to the provision of a railcar side bearing assembly employing an elastomeric block as the cushioning medium and which is structured to dissipate heat from the side bearing assembly during operation.

These and additional features, aims and advantages of the present invention will become more readily apparent from the drawings, description of the invention, and the appended claims.

DETAILED DESCRIPTION OF THE INVENTION

Figure 1:
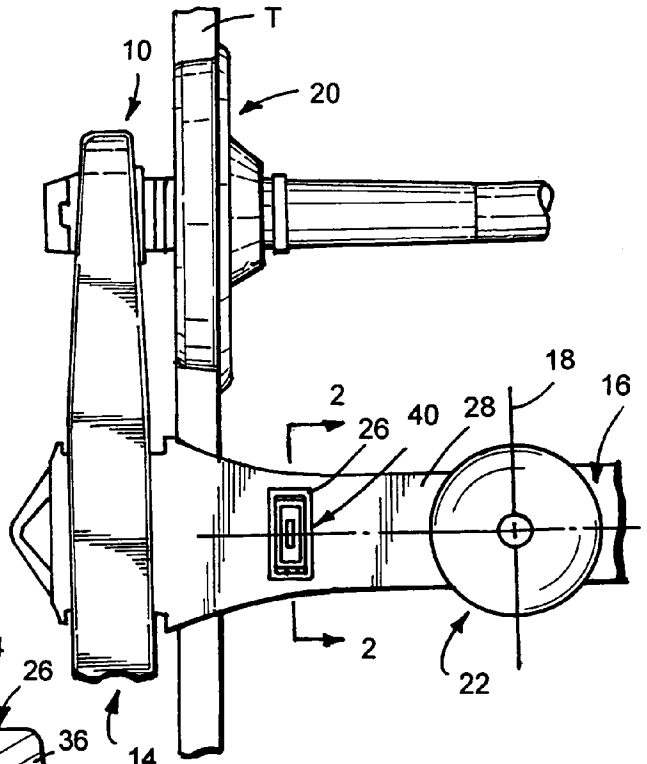
FIG. 1 is a top plan view of a portion of a railcar wheeled truck including a side bearing assembly embodying principals of the present invention.

While the present invention is susceptible of embodiment in multiple forms, there is shown in the drawings and will be described a preferred embodiment of the invention, with the understanding the present disclosure sets forth an exemplification of the invention which is not intended to limit the invention to the specific embodiment illustrated and described. Referring now to the drawings, wherein like reference numerals indicate like parts throughout the several views, there is shown in FIG. 1 a fragment of a railcar wheeled truck assembly, generally indicated by reference numeral 10, which supports and allows a railcar body 12 (FIG. 2) to ride along and over tracks T. Truck assembly 10 is of a conventional design and includes a side frame 14, a bolster 16, extending generally transversely relative to a longitudinal centerline 18 of the railcar body 12, and a wheel set 20. A conventional center bearing plate 22 is suitably mounted on the bolster 16 for pivotally supporting one end of the car body 12. On opposite lateral sides of the bearing plate 22, the bolster 16 of the illustrated truck assembly has a conventional box-like shaped receptacle or housing 26 (with only one housing being shown). Each box-like receptacle or housing 26 is either formed integral with or secured, as by welding or the like, to project upwardly from an upper surface 28 of the bolster 16 and can take different forms. In the version illustrated in FIG. 3, receptacle 26 includes a pair of generally parallel and spaced vertical side walls 33 and 34 and a pair of generally parallel and spaced end walls 35 and 36. The upper ends or extremes of the walls 33, 34, 35 and 36 terminate a predetermined distance above the upper surface 28 of the bolster 16. Moreover, and in the form shown, the wall structure 33, 34, 35 and 36 on housing 26 defines a pocket 38. The end walls 35, 36 of housing 26 are typically spaced apart a further distance than are the side walls 33, 34 such that the margin of pocket 38 is generally rectangular; with a length thereof extending generally longitudinally and generally parallel to the axis 18 (FIG. 1). The length of each opening or pocket 38 defined by the receptacle 26 can vary between each other and between railcars. Suffice it to say, the elements and structures set forth above are well known in the art and further description of such elements and structures will not be further set forth except where necessary for a complete understanding of the present invention.

Figure 2:
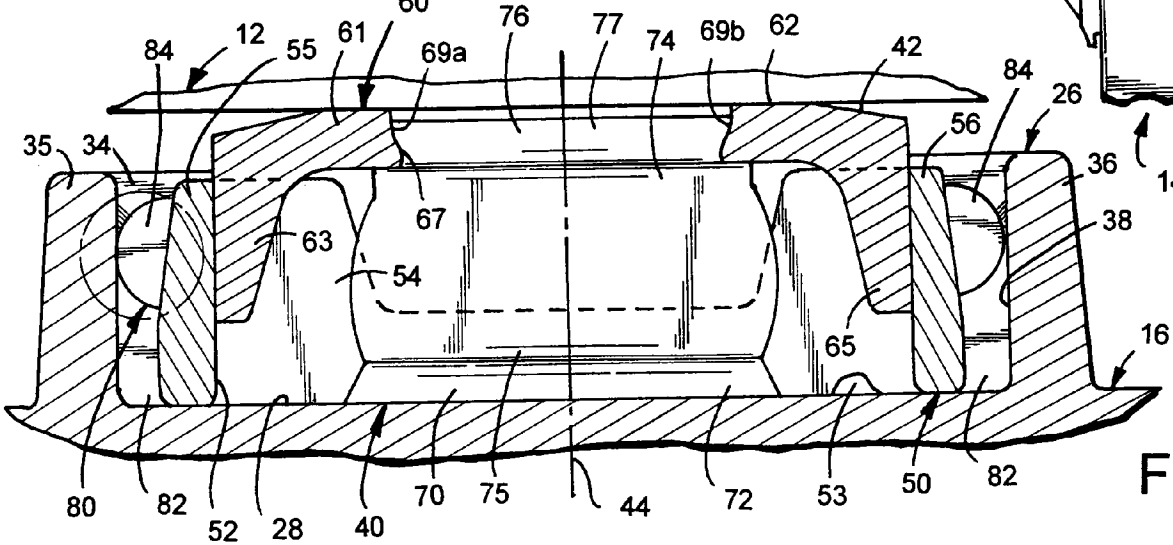
FIG. 2 is a longitudinal sectional view taken along line 2—2 of FIG. 1.

A constant contact side bearing assembly 40, according to the present invention, is designed to be accommodated within the pocket or recess 38 defined by each receptacle 26 on the bolster 16 for supporting and frictionally engaging an underside 42 of the railcar body 12. As shown in FIG. 2, bearing assembly 40 defines an axis 44 extending generally normal to the surface 28 of the bolster 16 after assembly 40 is arranged in operable combination with the bolster 16. The side bearing assembly 40 illustrated for exemplary purposes is specifically designed with a low profile. It should be appreciated, however, the principals of this invention equally apply to railcar side bearings configured to operate in combination with railcars having a standard nominal working space of about five and one-sixteenth inch between the truck bolster and the car body underside. Suffice it to say, bearing assembly 40 preferably includes a two-part housing assembly including a housing or cage 50 and a cap or friction member 60 arranged for guided movements relative to the housing 50. A spring 70 is arranged in operable combination with and positions the bearing cap 60 relative to the upper surface 28 of the bolster 16.

Figure 3:
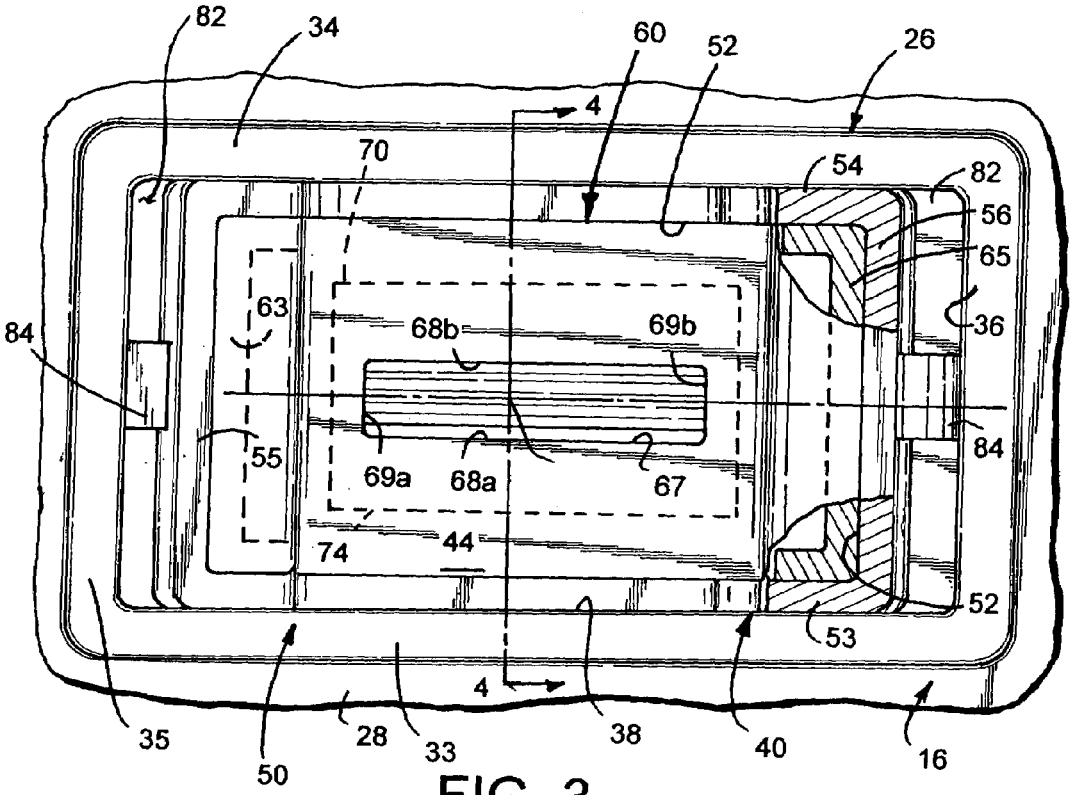
FIG. 3 is an enlarged top plan view of one embodiment of the present invention.

In a preferred form, the housing or cage 50 of the side bearing is preferably formed from metal and, as illustrated in FIG. 3, has walls or upstanding wall structure configured to fit within the walled receptacle 26 on the railcar bolster 16. Returning to FIG. 2, bearing housing 50 preferably extends circumferentially about the spring 70 and defines a cavity 52 extending therethrough and open at opposite ends. In the illustrated embodiment, the marginal edge of cavity 52 has a generally rectangular profile. As shown, bearing housing 50 has a bottom 51 and includes pair of generally parallel and spaced vertical sides 53 and 54 disposed to opposed lateral sides of the bearing assembly axis 44 and a pair of generally parallel and spaced ends 55 and 56 joined to the sides 53, 54 and disposed to opposed longitudinal sides of the bearing assembly axis 44.

In the illustrated embodiment, the lateral distance between the outer surfaces of sides or side walls 53, 54 of bearing housing 50 is slightly less than the lateral distance between inner surfaces of the side walls 33, 34 of the receptacle 26 into which bearing 40 is to be fitted whereby limiting lateral or sideways movements of the bearing 40, especially during railcar use. Because the bearing housing 50 is loosely accommodated within pocket 38, the lower end of the bearing housing 50 sits on the upper bolster surface 28 following insertion of the side bearing assembly 40 into the bolster receptacle 26. Bearing housing 50 is preferably configured such that, with the lower extreme of bearing housing 50 engaging bolster surface 28, upper ends of the walls 53, 54, 55 and 56 terminate below the upper extreme edge of the receptacle 26 on the bolster 16.

Figure 4:
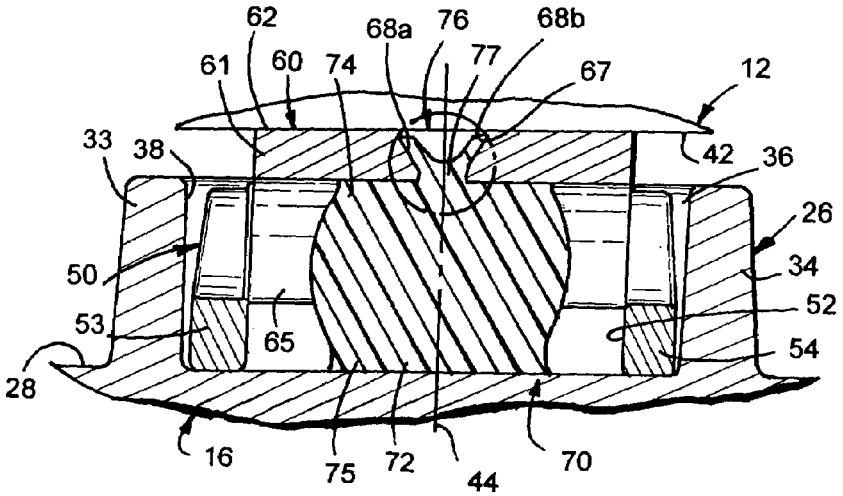
FIG. 4 is a sectional view taken along line 4—4 of FIG. 3.

The cap or friction member 60 is also preferably formed from metal. As shown, cap 60 overlies and transmits loads to the spring 70 during operation of the bearing assembly 40. As illustrated in FIGS. 2 and 4, cap 60 has a top plate 61 defining a generally flat surface 62 adapted to frictionally engage and establish metal-to-metal sliding contact with the car body underside 42. In the illustrated embodiment, cap 60 includes walls or wall structure depending from and preferably formed integral with the top plate 61. In one form, the depending walls or wall structure on cap 60 cooperates with the upstanding walls or wall structure on housing 50 to guide cap 60 for generally coaxial movements relative to housing 50.

In the embodiment illustrated in FIGS. 2, 3 and 4, the depending wall structure on cap 60 is comprised of a pair of longitudinally spaced end walls 63 and 65 which are connected to and depend from the top plate 61. In a preferred embodiment, cap 60 defines openings along opposed sides thereof and extending between the end walls 63 and 65. Suffice it to say, the depending wall structure on cap 60, including the end walls 63 and 65, is configured to complement and operably cooperate with the marginal edge surrounding the opening 52 defined by bearing housing 50 whereby inhibiting horizontal shifting movements of the cap 60 relative thereto. As shown, and when the spring 70 is arranged in operable combination with the assembly 40, the free or terminal ends of the end walls 63 and 65 are vertically spaced from the upper surface 28 of the bolster 16 a greater distance than is measurable between the underside 42 of the car body 12 and the upper extreme end of the housing 26 on the bolster 16.

The purpose of spring 70 is to position the side bearing cap 60 relative to the bolster 16 and to develop a predetermined preload or suspension force thereby urging cap plate 61 toward and into substantially constant friction engagement with the underside 42 of the car body 16. The preload or suspension force developed by spring 70 allows the side bearing assembly 40 to absorb forces imparted thereto when the car body 12 tends to roll and furthermore inhibits hunting movements of the wheeled truck assembly 12 relative to the car body 12. Suffice it to say, spring 70 is designed to develop a preload force ranging between about 7,000 and about 9,000 pounds.

As will be appreciated, the shape of spring 70 can vary from that illustrated for exemplary purposes without detracting or departing from the spirit and scope of the invention. Moreover, spring 70 can be formed from a myriad of different materials without detracting or departing from the spirit and scope of the invention. That is, spring 70 can be formed from either spring loaded steel elements or elastomeric blocks or a combination of both. Suffice it to say, a substantial portion of spring 70 is disposed within the cavity 52 defined by bearing housing 50 and is configured for placement between surface 28 on bolster 16 and an underside of the top plate 61 on the side bearing cap 60. In one form, spring 70 includes a first end 72 adapted to abut and directly engage that portion of the bolster surface 28, defined within parameters defined by the upstruck receptacle or housing 26, and an axially spaced second end 74.

Spring 70 preferably includes a formed, resiliently deformable block or column of elastomeric material 75 having a predetermined length and a predetermined cross-sectional shape capable of developing the required preload force for the side bearing assembly 40. Preferably, the spring block or column 75 is formed from a copolyesther polymer elastomer of the type manufactured and sold by the DuPont Company under the tradename HYTREL. Ordinarily, a HYTREL elastomer has inherent physical properties which make it unsuitable for use as a spring. Applicants' assignee, however, has advantageously discovered it is possible to impart spring-like characteristics to a HYTREL elastomer. Coassigned U.S. Pat. No. 4,198,037 to D. G. Anderson better describes the above noted polymer material and forming process and is herein incorporated by reference. When used as a spring, the thermoplastic material forming spring 70 has an elastic to plastic ratio greater than 1.5 to 1.

In the illustrated embodiment, the bearing cap 60 and spring 70 are cooperatively designed and configured to be interlocked relative to each other. Preferably, the generally flat railcar engaging surface portion 61 of the bearing cap 60 and the second end 74 of the spring 70 have interlocking instrumentalities, generally identified by reference numeral 76, for securing the resilient block 75 and the bearing cap 60 in operable combination relative to each other. As will be appreciated from an understanding of the invention, by securing the bearing cap 60 and spring 70 in operable combination relative to each other, such an arrangement likewise positions the spring 70 relative to the housing 50 of the side bearing assembly 40.

The interlocking instrumentalities 76 can take a myriad of different types for achieving the above-mentioned ends. As shown in FIGS. 2 through 4, plate 61 of cap 60 preferably defines a generally centralized throughbore 67 into which a portion of the spring 70 is received and captured. As shown in FIG. 3, the second end 74 of spring 70 is larger in cross-section than is the throughbore or opening 67. In the illustrated form, opening 67 is provided with laterally spaced side walls 68*a* and 68*b* and longitudinally spaced end walls 69*a* and 69*b*. Notably, the side walls 68*a*, 68*b* and end walls 69*a* and 69*b* are each vertically slanted such that the throughbore or opening 67 in the top cap 61 decreases in cross-section as measured from the upper friction engaging surface 62 on the bearing cap 60.

Figure 5:
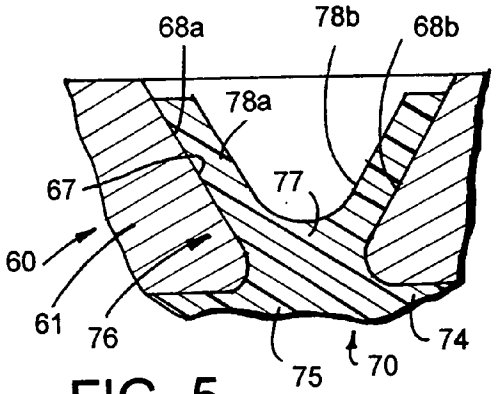
FIG. 5 is an enlarged view of that area encircled in FIG. 4.

Preferably, the second end 74 of the elastomeric spring block 75 is formed with a projection 77 sized to be accommodated within opening 67 in the bearing cap 60. Toward the free end thereof, and as shown in FIG. 5, the projection 77 is formed with a pair of angularly diverging ears or fingers 78*a* and 78*b*. The ears 78*a* and 78*b* of the projection complement and cooperate with the side walls 68*a* and 68 of the opening 67 so as to maintain the bearing cap 60 and spring 70 in operable combination relative to each other. Moreover, and as shown in FIG. 2, the projection 77 on the elastomeric block 75 forming spring 70 has a length less than the length between the end walls 69*a* and 69*b* of the opening 67. As such, the end walls 69*a* and 69*b* of the opening 67 serve as stops for limiting longitudinal displacement of the spring 70 relative to the cap 60 during operation of the side bearing assembly 40.

Figure 6:
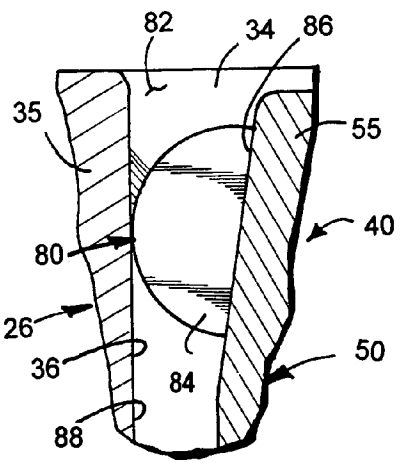
FIG. 6 is an enlarged view of that area encircled in FIG. 2.
Figure 6:
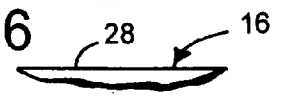

Side bearing assembly 40 further includes an apparatus, generally indicated in FIGS. 2 and 6 by reference numeral 80. In a preferred form, apparatus 80 is arranged in operable combination with the bearing housing 50 and wall structure of the bolster housing 26 for positively securing and positioning the side bearing assembly 40 relative to the truck bolster 16. More specifically, and as shown in FIGS. 2 and 4, apparatus 80 is operably engagable with the wall structure of the housing or receptacle 26 and the body member or side bearing housing 50 for operably securing the body member or side bearing housing 50 against movement relative to the railcar bolster 16.

The apparatus 80 for positively securing and positioning the side bearing assembly 40 relative to the bolster 16 can take different forms without detracting or departing from the spirit and scope of the present invention. As mentioned, the side bearing assembly 40 is sized to longitudinally fit loosely within pocket 38 defined by the bolster receptacle 26. As shown in FIGS. 2 and 3, and after bearing assembly 40 is accommodated within the receptacle 26, the rigid and upstruck end walls 35 and 36 of the receptacle housing 26 are arranged in confronting and generally parallel but longitudinally spaced relation relative to the end walls 55, and 56, respectively, of the bearing housing 50. That is, an open-top opening or gap 82 is defined between the confronting walls 35, 55 and 36, 56, respectively, of the receptacle 26 and the bearing housing 50. As such, the side bearing assembly 40 is specifically designed to readily fit within pockets 26 of varying sizes on bolster 16, thus, adding great versatility to the invention.

In the illustrated embodiment, a locking member or spacer 84 is installed and, preferably snugly inserted into each opening 82 defined between the confronting walls 35, 55 and 36, 56, respectively, of the receptacle 26 and bearing housing 50. Thereafter, each locking member or shim spacer 84 is fastened or secured, as by welding or a suitable mechanical device, preferably to the adjacent end wall of the receptacle 26 to inhibit longitudinal shifting movements of the bearing assembly 40 relative to the bolster 16.

As illustrated, each pair of confronting walls 35, 55 and 36, 56, respectively, disposed to opposed longitudinal sides of the axis 44 are preferably configured to further enhance securement of the bearing assembly 40 relative to the bolster 16. In that form shown in FIG. 6, each pair of confronting walls 35, 55 and 36, 56, respectively, disposed to opposed lateral sides of the axis 44 defined by the bearing assembly 40 defines a surface portion 86 which is inclined with respect to the other surface 88 such that the surfaces 86 and 88 angularly diverge relative to each other and away from the bottom 51 of the housing 50 or the upper surface 28 of the bolster 16 so as to provide the opening 82 with a generally wedge-shape. As will be appreciated, the preferable wedge-shape of the opening 82 enhances reception and retention of the wedge-shaped spacer 84 therewithin. In the embodiment illustrated in FIG. 2, only a lengthwise surface portion of the confronting walls of the walled receptacle 26 and side bearing assembly housing 50 is illustrated as inclined or diverging relation relative to the opposed surface portion as it extends from the bottom 51 of the housing 50 but it should be appreciated the entire length of the respective wall could be slanted or inclined without detracting or departing from the spirit and scope of the present invention.

As the railcar travels over tracks T, the wheeled truck 10 naturally hunts or yaws about a vertical axis of the truck. Accordingly, frictional sliding movements are established at and along the interface of the railcar body underside 42 and the flat engaging surface 62 of the bearing cap 60, thus, creating significant and even excessive heat. As will be appreciated, when the heat developed by the sliding action of the railcar body 12 over the side bearing assembly 40 exceeds the heat deflection temperature of the thermoplastic elastomer 75, deterioration, deformation and even melting of the spring 70 can result, thus, adversely affecting side bearing performance.

Accordingly, another aspect of the invention relates to configuring the side bearing assembly 40 to promote dissipation of heat away from the elastomeric spring 70 thereby prolonging the usefulness of the side bearing assembly 40. Toward those ends, and in the form shown in FIG. 2, the height of at least a midportion of the side walls 53 and 54 of bearing housing 50 is significantly reduced relative to the height of the end walls 55, 56. Moreover, the preferred configuration of the bearing cap 60 is configured to promote dissipation of heat away from the spring 70. The reduced height of the housing side walls 53 and 54, and the preferred configuration of the bearing cap 60, independently and in combination, readily allows air to freely flow into and through the cavity 52 in the bearing assembly 40 whereby promoting dissipation of heat away from the side bearing spring 70. Additionally, configuring the bearing cap 60 with the elongated throughbore or opening 67 moves heat generated from the friction engagement of the bearing cap 60 with the railcar body underside 42 toward the peripheral edges of the cap 60 and away from the elastomeric spring 70 material which is normally susceptible to heat damage.

In those embodiments of the bearing assembly having a bottomless housing design, spring 70, regardless of its design, is permitted to extend through the bottom of the bearing housing to directly abut and engage the upper surface 28 of the bolster 16. As such, the vertical space normally consumed or taken by the bottom of the bearing assembly cage or housing has been eliminated and advantageously used to reduce the overall height of and provide a low profile to the bearing assembly 40. Whereas, in one form for the bearing assembly 40, the measurable distance between the upper friction engaging surface 62 and the lowermost wall structure surface of the bearing housing 50 ranges between about 2.5 inches and about 4.5 inches. In another design, the bottomless design of the housing assembly yields a bearing assembly having a side profile measuring about 2.625 inches in overall height.

Another important feature of the present invention involves maintaining the friction surface 62 of assembly 40 in substantially constant contact with the underside 42 of the railcar body 12. As such, hunting or yawing motions of the wheeled truck 10 are inhibited, thus, yielding improved performance to the railcar. Moreover, when rolling movements of the railcar body 12 are excessive, the side bearing assembly 40 of the present invention allows the car body to "go solid" into the bolster 16 through the walled receptacle 26 on the truck bolster 16 whereby limiting damages to and this prolonging the life of the side bearing assembly 40.

In addition to the above, the side bearing assembly of the present invention is configured to be accommodated within existing housing structures on the bolster. As such, there is no need to spend valuable time removing or cutting away the existing housing structure on the bolster. In a preferred embodiment, the side bearing assembly 40 is configured to loosely fit within different size pockets defined by the existing housing or receptacle on the bolster. Thereafter, apparatus 80 is used to positively locate and secure the constant contact side bearing assembly 40 in the pocket 38 defined by and relative to the railcar bolster 16.

From the foregoing, it will be observed numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed is:

1. A constant contact side bearing assembly adapted to be accommodated within a rectangularly shaped, open top receptacle on an upper surface of a railcar bolster, said receptacle having a pair of generally parallel and spaced side walls and a pair of generally parallel and spaced end walls, said constant contact side bearing assembly comprising:

a spring;

a housing defining a cavity wherein said spring is accommodated, and wherein said housing has a generally rectangular shape including two sides and two ends, with each side and each end of said housing being disposed to opposite sides of an axis defined by said side bearing assembly and extending generally normal to the upper surface of said bolster, and wherein the generally rectangular shape of said housing loosely fits within said open top receptacle on said bolster;

a cap positioned by and overlying an end of said spring, with said cap being guided for telescopic movements relative to said housing, and with said cap including a generally flat portion defining an upper extreme of said side bearing assembly after said side bearing assembly is arranged in operable combination with said railcar bolster; and an apparatus for positively securing said relative to the railcar bolster.

2. The constant contact side bearing assembly according to claim 1, wherein a distance ranging generally between 2.5 inches and 4.5 inches is measurable between the upper extreme of said side bearing assembly and said bolster surface after said side bearing assembly is accommodated in said receptacle.

3. The constant contact side bearing assembly according to claim 1, wherein said spring is configured such that an upper portion of said side bearing assembly is positioned above an upper extreme of the walls of said receptacle as long as the spring of said side bearing assembly is in an uncompressed state and when initial loadings are directed against said side bearing assembly during operation of the railcar on which said side bearing assembly is arranged in operable combination.

4. The constant contact side bearing assembly according to claim 1, wherein said spring comprises a resilient spring block having a predetermined length and a predetermined cross-sectional shape.

5. The constant contact side bearing assembly according to claim 4, with the generally flat portion on said cap and said resilient block having interlocking instrumentalities for securing the resilient block and said cap in operable combination relative to each other.

6. The constant contact side bearing assembly according to claim 4, wherein said resilient spring block is formed from an elastomer material.

7. The constant contact side bearing assembly according to claim 6, wherein said housing is configured to promote the dissipation of heat away from said elastomer spring block.

8. The constant contact side bearing assembly according to claim 6, wherein said cap is configured to promote the dissipation of heat away from said elastomer spring block.

9. The constant contact side bearing assembly according to claim 1, wherein said cap is adapted to telescopically move relative to and be guided by said housing, and wherein said housing and said cap are configured to promote the movement of air though said cavity and away from said spring.

10. The constant contact side bearing assembly according to claim 1, wherein the ends of said housing and the end walls of said receptacle define a pair of confronting surfaces disposed therebetween and to opposite sides of said side bearing assembly axis, and wherein said apparatus includes a pair of wedge-shaped shims insertable into an opening defined between the confronting surfaces of each pair of confronting surfaces whereby securing said side bearing assembly to said bolster.

11. The constant contact side bearing assembly according to claim 1, wherein the ends of said housing and the end walls of said receptacle define a pair of confronting surfaces disposed therebetween and to opposite sides of said side bearing assembly axis, with each pair of confronting surfaces having at least one surface which is inclined with respect to the other surface such that said surfaces diverge away from each other as said surfaces extend away from said upper bolster surface whereby defining a wedge-shaped opening therebetween.

12. The constant contact side bearing assembly according to claim 11, wherein said apparatus for positively securing said housing to the upper surface of said bolster includes spacers insertable into each wedge-shaped opening defined by said confronting surfaces on said housing and said receptacle to inhibit endwise movement of side housing relative to said walled enclosure.

13. The constant contact side bearing assembly according to claim 12, wherein each spacer is configured as a wedge shim.

14. The constant contact side bearing according to claim 1, wherein the recess defined by said we housing extends through said housing and is open at opposite ends.

15. The constant contact side bearing according to claim 1, wherein an end of said spring engages a portion of the upper surface on said bolster surrounded by the walled receptacle.

16. A constant contact side bearing assembly adapted to be arranged in combination with a railcar bolster with an upper surface, said side bearing assembly comprising;

a housing defining a recess extending through said housing and is open at opposite ends, and wherein said housing and a walled receptacle on the upper surface of said bolster define a pair of confronting surfaces arranged on opposed sides of an axis defined by said side bearing assembly and extend generally normal to the upper surface of said bolster;

a spring accommodated within said housing;

inserts for securing and locating said housing of said side bearing assembly within the walled receptacle on said bolster, with at least one insert being positionable between said confronting surfaces on the walled receptacle and the housing on each side of said side bearing axis for inhibiting shifting movement of said housing relative to said bolster, and a cap overlying one end of said spring, said cap being mounted for reciprocator guided movements by and relative to said housing with a generally flat railcar body engaging portion on said cap being positioned relative to said housing and said walled receptacle by said spring.

17. In combination, a railcar bolster connected to a wheeled truck and a constant contact side bearing assembly, comprising:

a walled receptacle adapted for securement to an upper surface on said bolster, a housing assembly configured to loosely fit within said walled receptacle, said housing assembly including a friction member having a railcar engaging portion which is spring biased for engagement with an underside of a railcar body supported by and for limiting hunting movements of said wheeled truck, and with said housing assembly further including a base for accommodating a spring used to bias the railcar engaging portion of said friction member into engagement with the underside of the railcar body and for guiding vertical movements of said friction member relative to said base; and an apparatus disposed between an inner surface on said walled receptacle and an outer surface on said base for operably securing said base relative to said railcar bolster and for locating said side bearing assembly relative to the railcar bolster.

18. The side bearing assembly according to claim 17 wherein said spring extends through said base of said housing assembly such that one end of said spring abuttingly engages with that portion of the upper surface of said bolster surrounded by said walled receptacle.

19. The side bearing assembly according to claim 17 wherein said apparatus for operably securing the base of said housing assembly against movements includes at least one insert fixed between the inner surface of said walled receptacle and an outer surface on said base.

* * * * *

UNITED STATES PATENT AND TRADEMARK OFFICE

CERTIFICATE OF CORRECTION

PATENT NO. : 6,957,611 B2
DATED : October 25, 2005
INVENTOR(S) : William P. O'Donnell and Paul B. Aspengren It is certified that error appears in the above-identified patent and that said Letters Patent is hereby corrected as shown below:

Column 10,
Line 37, "installed and, preferably snugly" should be -- installed and, preferably, snugly --;

Column 12,
Line 39, "securing said relative" should be -- securing said housing relative --;

Column 13,
Line 44, "said we housing" should be -- said housing --.

Signed and Sealed this

Twenty-eighth Day of March, 2006

JON W. DUDAS
*Director of the United States Patent and Trademark Office*